United States Patent [19]

Kleefeldt et al.

[11] Patent Number: 4,637,239

[45] Date of Patent: Jan. 20, 1987

[54] VEHICULAR LOCK SYSTEM WITH ANTILOCKOUT PROTECTION

[75] Inventors: Frank Kleefeldt, Heiligenhaus; Peter Bartel, Hattingen, both of Fed. Rep. of Germany

[73] Assignee: Kiekert GmbH & Co Kommanditgesellschaft, Heiligenhaus, Fed. Rep. of Germany

[21] Appl. No.: 692,023

[22] Filed: Jan. 16, 1985

[30] Foreign Application Priority Data

Jan. 27, 1984 [DE] Fed. Rep. of Germany ..... 3402788

[51] Int. Cl.[4] ..... E05B 65/36

[52] U.S. Cl. ..... 70/264

[58] Field of Search ..... 70/264, 262, 263, 265, 70/277, 279, 280, 281, 282; 340/825.056, 825.69

[56] References Cited

U.S. PATENT DOCUMENTS 4,342,209 8/1982 Kleefeldt ..... 70/264

4,440,006 4/1984 Kleefeldt ..... 70/264

*Primary Examiner*—Robert L. Wolfe

*Attorney, Agent, or Firm*—Karl F. Ross; Herbert Dubno

[57] ABSTRACT

A vehicular lock system used in combination with a battery has at least one latch settable in an unlocked position, a locked position permitting manual opening only by a key, and an antitheft position preventing manual opening even with the key. An electric servomotor is powered by the battery to displace the latch between at least the antitheft and locked positions. This servomotor is unable to move the latch between the positions when the battery power is below a predetermined minimum. An externally operable control unit is connected between the battery and the servomotor for feeding the battery power to the servomotor for displacing the latch at least between the antitheft and locked positions. A reference signal corresponding to the minimum battery power is compared to the battery power to displace the latch from the antitheft position to the locked position when the battery power falls below the predetermined minimum represented by the reference signal.

4 Claims, 1 Drawing Figure

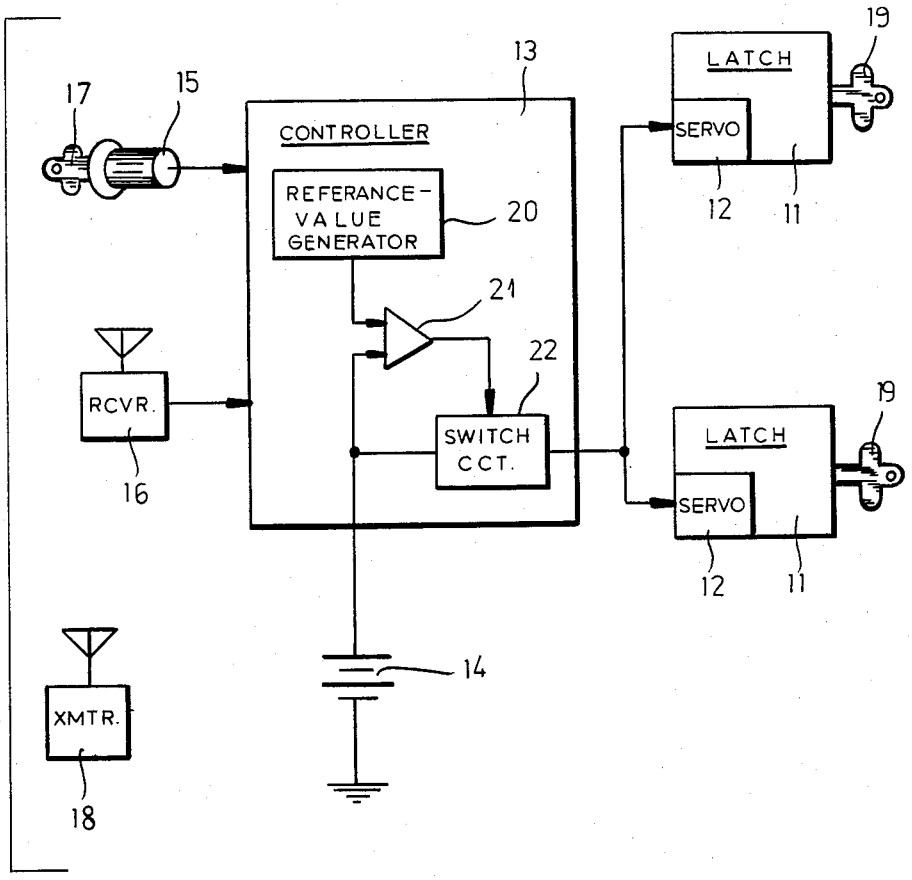
17
15
13
CONTROLLER
REFERANCE-
VALUE
GENERATOR
20
21
22
SWITCH
CCT.
RCVR.
16
XMTR.
18
14
LATCH
SERVO
12
11
19
LATCH
SERVO
12
11
19

VEHICULAR LOCK SYSTEM WITH ANTILOCKOUT PROTECTION

FIELD OF THE INVENTION

The present invention relates to a vehicular lock system of the antitheft type. More particularly this invention concerns protecting the user of such a system from being locked out of his or her vehicle.

BACKGROUND OF THE INVENTION

Vehicular lock systems with so-called antitheft protection are described in commonly owned Pat. Nos. 4,440,006, 4,342,209, and 4,364,249. They each have a door latch settable in an unlocked position in which the controlled door, hood, or trunk can be opened without a key, a locked position permitting manual opening of the controlled door, hood, or trunk only by a key, and an antitheft position preventing such manual opening even with the key. At least one of the door latches in each of these systems, normally termed the master latch, can be directly set in the antitheft position to indirectly set the other latches of the vehicle in their antitheft positions. Thus with such an arrangement the antitheft setting makes the vehicle very secure, as only the master latch that can set this position can move the slave latches back into locked positions from which they can be moved to the unlocked positions like standard latches.

Such a vehicular lock system is used in combination with a battery and at least each slave latch has an electric servomotor powerable by the battery for displacement of the latch between at least the antitheft and locked positions. The control unit is connected between the battery and the controller for feeding the battery power to the servomotor for setting the latch at least in the antitheft and locked positions, depending on how the control unit is being operated or energized. As a rule, therefore the systems are of the central locking type that can also all be locked or unlocked from the master latch.

The control unit is typically operated by one of the latches or by a separate switch which can only be operated by a special key, for instance of the type described in U.S. Pat. Nos. 4,320,639 and 4,357,815, so that only the person possessing the master key can set the system in the antitheft position or take it out of the antitheft setting. This allows, for instance, a car owner to always keep this master key, while giving out to car-park operators and the like keys only effective to move the latches between the locked and unlocked positions so that even if these keys fall into the wrong hands the vehicle can be effectively locked up.

It is also possible to be able to move the system from the antitheft position to the locked position by means of a sophisticated electronic arrangement of the type described in copending patent application No. 568,610 and copending patent application No. 555,471 of W. Bongard et al. These coded arrangements allow remote operation of the control unit by means of a radio-frequency transmitter and are normally very secure.

Thus such arrangements require an on-board power source, usually the motor-vehicle battery although a separate source can be provided. If the voltage of the source drops below a predetermined minimum level, for instance when the lights or radio are accidentally left on or when the vehicle is stored long-term, the lock system can get stuck in the antitheft position since the power available is insufficient to operate the servomotors or power the receiver.

The result is therefore that the user is locked out of his or her vehicle. When the lock system is particularly secure, it might have to be forced to open up the vehicle, something that can result in costly damage.

OBJECTS OF THE INVENTION

It is therefore an object of the present invention to provide an improved antitheft-type lock system.

Another object is the provision of such an antitheft-type lock system which overcomes the above-given disadvantages, that is which avoids the above-described possibility of locking out the user.

SUMMARY OF THE INVENTION

A vehicular lock system used in combination with a battery according to the invention has at least one latch settable in an unlocked position, a locked position permitting manual opening only by a key, and an antitheft position preventing manual opening even with the key. An electric servomotor is powered by the battery to displace the latch between at least the antitheft and locked positions. This servomotor is unable to move the latch between the positions when the battery power is below a predetermined minimum. An externally operable control unit is connected between the battery and the servomotor for feeding the battery power to the servomotor for displacing the latch at least between the antitheft and locked positions. A reference signal corresponding to the minimum battery power is compared to the battery power to displace the latch from the antitheft position to the locked position when the battery power falls below the predetermined minimum represented by the reference signal.

Normally the system is of the central type with a plurality of such latches with respective servomotors connected to the control and comparator means for joint operation thereby. One of these latches can be a wholly mechanical sending unit and therefore constitute part of the control unit. In this case the control unit includes a special key-operable switch.

It is also within the scope of this invention for the control unit to include a receiver operable by a transmitter of the type described above.

DESCRIPTION OF THE DRAWING

The above and other features and advantages will become more readily apparent from the following, reference being made to the accompanying drawing the sole FIGURE of which is a diagrammatic view of a lock system of the present invention.

SPECIFIC DESCRIPTION

As seen in the drawing, a lock system according to this invention has a pair of latches 11 (see above-cited U.S. Pat. Nos. 4,440,006, 4,342,209, and 4,364,249) each operable between a respective antitheft and locked position by a respective electric servomotor 12 that is connected via a controller 13 with the vehicle battery 14. This controller 13 in turn can be operated either by a key switch 15 (see above-cited U.S. Pat. Nos. 4,320,639 and 4,357,815) or by a receiver 16 (see above-cited patent applications Ser. Nos. 568,610 and 555,471 respectively operable by a key 17 or transmitter 18.

The latches 11, which normally are provided on the doors although they can also be on the trunk and hood of the vehicle, can only be moved by the respective servomotors 12 from the antitheft to the locked position. When in the antitheft position, as described above, the latches 11 cannot be operated even with the respective keys 19, but they can be moved by these keys 19 between the locked and unlocked positions.

According to the invention the controller 13 has or is associated with a reference-value generator 20 connected to one input of a comparator 21 whose other input is connected to the battery 14. When this comparator 21 determines that the battery voltage is falling to a level below which the battery power will be insufficient to operate the servos 12, this comparator 21 actuates these servos 12 by means of a switching circuit 22. Thus if, for instance, a vehicle with the system is left in long-term storage with the receiver 16 on so that the battery 14 is slowly depleted, the circuit 22 and comparator 21 will move the latches 11 from the antitheft position to the locked position before the battery becomes too weak to do this. The resultant loss in security is a small tradeoff against the annoyance of being locked out.

The signal generator 20 can be a long-life battery subject to minimal drain when in use and charging when the vehicle is operating. This reference value can also be generated right off the voltage of the battery by means of standard electronic circuitry.

Thus with the system of this invention the possibility of the vehicle being stuck in the antitheft position is eliminated by automatically switching it therefrom when the battery voltage drops too low. A vehicle can thus safely be left in long-term storage with the antitheft protection engaged, as even if the battery does fail the vehicle is still left locked, but with a dead battery so the car would be virtually impossible to steal. Otherwise it would take professional assistance and at least some damage to the vehicle to gain entrance to it.

I claim:

1. A vehicular lock system used in combination with a battery and comprising:

at least one latch settable in an unlocked position, a locked position permitting manually opening only by a key, and an antitheft position preventing manual opening even with the key;

an electric servomotor powerable by the battery for displacement of the latch between at least the antitheft and locked positions, the servomotor being unable to move the latch between the positions when the battery power is below a predetermined minimum;

externally operable control means connected between the battery and the servomotor for feeding the battery power to the servomotor for displacing the latch at least between the antitheft and locked positions;

means for generating a reference signal corresponding to the minimum battery power; and comparator means connected to the battery and to the generating means for comparing the battery power and the reference signal and connected to the control means for displacing the latch from the antitheft position to the locked position when the battery power falls below the predetermined minimum represented by the reference signal.

2. The lock system defined in claim 1 wherein a plurality of such latches with respective servomotors are connected to the control and comparator means for joint operation thereby.

3. The lock system defined in claim 1 wherein the control means includes a special key-operable switch.

4. The lock system defined in claim 1 wherein the control means includes a receiver, the system further comprising a transmitter capable of operating the control means by means of the receiver.

* * * * *